US011827013B2

(12) United States Patent
Mizutani et al.

(10) Patent No.: US 11,827,013 B2
(45) Date of Patent: Nov. 28, 2023

(54) DRYING DEVICE, PRINTING DEVICE AND PRINTING METHOD

(71) Applicants: Yuuki Mizutani, Kanagawa (JP); Chikako Hatta, Kanagawa (JP)

(72) Inventors: Yuuki Mizutani, Kanagawa (JP); Chikako Hatta, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 30 days.

(21) Appl. No.: 17/740,356

(22) Filed: May 10, 2022

(65) Prior Publication Data

US 2022/0371336 A1 Nov. 24, 2022

(30) Foreign Application Priority Data

May 19, 2021 (JP) ..... 2021-084338

(51) Int. Cl.
*B41J 11/00* (2006.01)

(52) U.S. Cl.
CPC ..... *B41J 11/002* (2013.01)

(58) Field of Classification Search
CPC ..... B41J 11/002; B41J 11/0024; C25D 11/04; C25D 11/08; C25D 11/246
See application file for complete search history.

(56) References Cited

U.S. PATENT DOCUMENTS

| | | | | |
|---|---|---|---|---|
| 6,144,836 | A | 11/2000 | Umeda et al. | |
| 2016/0273832 | A1* | 9/2016 | Asada | F26B 13/08 |
| 2020/0290372 | A1 | 9/2020 | Mizutani et al. | |
| 2020/0338905 | A1 | 10/2020 | Mizutani et al. | |

FOREIGN PATENT DOCUMENTS

| | | | |
|---|---|---|---|
| DE | 10 2009 010 625 | A1 | 9/2010 |
| JP | S57-100459 | A | 6/1982 |
| JP | 10-097106 | | 4/1998 |
| JP | 2004-021079 | | 1/2004 |
| JP | 2014-177102 | | 9/2014 |
| JP | 2016-173191 | | 9/2016 |
| JP | 2018-066552 | A | 4/2018 |
| JP | 2021-190183 | | 12/2021 |

OTHER PUBLICATIONS

Extended European Search Report dated Oct. 11, 2022 in European Patent Application No. 22170975.1, 9 pages.

* cited by examiner

*Primary Examiner* — Bradley W Thies
(74) *Attorney, Agent, or Firm* — XSENSUS LLP

(57) ABSTRACT

A drying device includes a heating member for conveying and heating a heating subject in a contact manner on which a liquid composition has been applied, the heating member including a substrate, a surface layer disposed on the substrate, the surface layer including a supporting layer including sulfuric acid anodized aluminum film having concave portions and non-concave portions, and a fluororesin at least partially attached to the concave portions, and a heating device for heating the heating subject via the surface layer, and a temperature measuring member for measuring the temperature of a temperature measuring point in a region of the heating member that has contacted the heating subject in a non-contact manner.

11 Claims, 4 Drawing Sheets

DRYING DEVICE, PRINTING DEVICE AND PRINTING METHOD

CROSS-REFERENCE TO RELATED APPLICATIONS

This patent application is based on and claims priority pursuant to 35 U.S.C. § 119 to Japanese Patent Application No. 2021-084338, filed on May 19, 2021, in the Japan Patent Office, the entire disclosure of which is hereby incorporated by reference herein.

BACKGROUND

Technical Field

The present disclosure relates to a drying device, a printing device, and a printing method.

Description of the Related Art

Inkjet printers include a drying device including a heating roller having a built-in heating source such as a halogen lamp for drying a printing medium onto which ink or processing fluid is applied.

SUMMARY

According to embodiments of the present disclosure, a drying device is provided which includes a heating member for conveying and heating a heating subject in a contact manner on which a liquid composition has been applied, the heating member including a substrate, a surface layer disposed on the substrate, the surface layer including a supporting layer including sulfuric acid anodized aluminum film having concave portions and non-concave portions, and a fluororesin at least partially attached to the concave portions, and a heating device for heating the heating subject via the surface layer, and a temperature measuring member for measuring the temperature of a temperature measuring point in a region of the heating member that has contacted the heating subject.

As another aspect of embodiments of the present disclosure, a printing device is provided which includes an applying device configured to apply a liquid composition to a heating subject and a drying device including a heating member for conveying and heating a heating subject in a contact manner on which a liquid composition has been applied, the heating member including a substrate, a surface layer disposed on the substrate, the surface layer including a supporting layer including sulfuric acid anodized aluminum film having concave portions and non-concave portions, and a fluororesin at least partially attached to the concave portions, and a heating device for heating the heating subject via the surface layer, and a temperature measuring member for measuring the temperature of a temperature measuring point in a region of the heating member that has contacted the heating subject.

As another aspect of embodiments of the present disclosure, a printing method is provided which includes applying a liquid composition to a heating subject, heating and conveying the heating subject on which the liquid composition has been applied in a contact manner by a heating member and measuring the temperature of a temperature measuring point in a region of the heating member that has contacted the heating subject in a non-contact manner.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
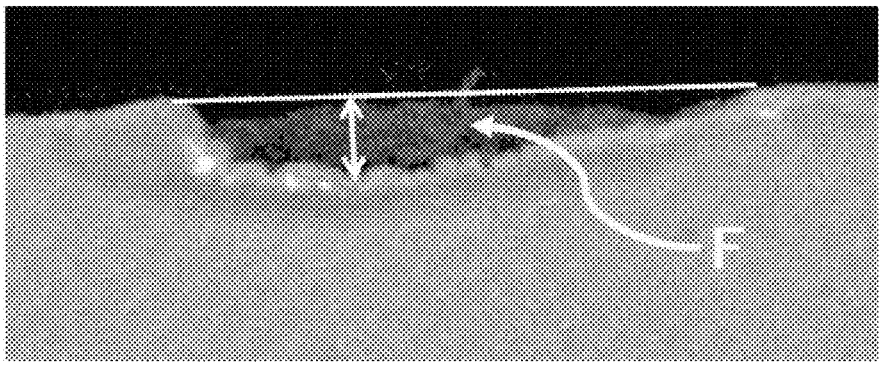
FIG. 1 is a micrograph of an example of a cross section of the supporting layer having concave portions.

The accompanying drawings are intended to depict example embodiments of the present invention and should not be interpreted to limit the scope thereof. The accompanying drawings are not to be considered as drawn to scale unless explicitly noted. Also, identical or similar reference numerals designate identical or similar components throughout the several views.

DESCRIPTION OF THE EMBODIMENTS

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

A drying device having a heating member for heating a heating subject to which a liquid composition is applied in a contact manner while conveying the subject involves a problem such that components derived from the composition transfer from the subject to the member, and it is challenging to supply an amount of heat while substantially maintaining the temperature of the member that lowers upon contact between the subject and the member.

According to the present disclosure, a drying device is provided which minimizes transfer of the component derived from liquid compositions from a heating subject to a heating member and supplies the amount of heat while substantially maintaining the temperature of the member that lowers upon contact between the subject and the member.

Next, an embodiment of the present disclosure is described.

Drying Device

The drying device of the present embodiment heats and dries a heating subject on which a liquid composition is applied. The drying device includes a heating member for conveying and heating a heating subject in a contact manner on which a liquid composition has been applied, a temperature measuring member for measuring the temperature at a position i.e., temperature measuring position, in the region of the heating member that has contacted the heating subject, and other optional members.

Heating Member

The heating member in the drying device conveys and heats the heating subject in a contact manner on which a liquid composition has been applied. It preferably contacts the heating subject on the side of the surface on which the liquid composition has been applied.

The heating member includes a substrate, a surface layer disposed on the substrate and brought into contact with the heating subject, and a heating device for applying heat to the subject via the surface layer.

Surface Layer

The surface layer of the heating member is brought into contact with the heating subject. It includes a supporting layer having concave portions and non-concave portions, fluororesin at least attached to the concave portions, and other configuration members.

Supporting Layer

The supporting layer contains sulfuric acid anodized aluminum, in other words, sulfuric acid anodized aluminum film layer. It may optionally further more contains other materials. Inclusion of sulfuric acid anodized aluminum means containing a material derived from sulfuric acid anodized aluminum treatment, which represents anodizing aluminum in sulfuric acid aqueous solution. That is, a layer containing a material derived from sulfuric acid anodized aluminum treatment contains aluminum oxide and a sulfur component detected therein. Detecting a sulfur component means obtaining data showing that a sulfur component is present when mapping the sulfur component for a cross section of a supporting layer. One way of mapping a sulfur component is subjecting a cross section of a supporting layer to elemental analysis using an in-built EDS system, Phenom ProX, manufactured by Phenom-World BV.

One way of determining whether a layer contains sulfuric acid anodized aluminum, in other words, a layer containing aluminum oxide and a sulfur component is detected, is to obtain data showing that the sulfur component, the aluminum component, and the oxygen component are present in the same region when mapping a sulfur component, an aluminum component, and an oxygen component for a cross section of a supporting layer. A specific way of this mapping is to subject a cross section of a supporting layer to elemental analysis using an in-built EDS system, Phenom ProX, manufactured by Phenom-World By.

A sulfuric acid anodized aluminum contained in a surface layer as a component improves the emissivity of the layer when compared with a surface layer containing a material such as an aluminum alloy. In such a case, a temperature measuring device for detecting infrared emitted from a surface layer, which is described later, can precisely detect the temperature of the layer.

As described above, since the supporting layer contains sulfuric acid anodized aluminum, it has concave portions on its surface. The concave portions derive from the sulfuric acid anodized aluminum treatment. It is preferable not to subject a supporting layer to another treatment for forming concave portions in terms of manufacturing. The concave portion is described with reference to FIG. 1. FIG. 1 is a micrograph of an example of a cross section of the supporting layer having concave portions.

As illustrated in FIG. 1, the concave portion is a structure having a dent on the surface. As illustrated in FIG. 1, fluororesin F attaches to the concave portion.

The reason of fluororesin preferably attaching to the concave portion is described below.

Fluororesin softens when it attaches to the surface of a heating member having a high surface temperature. The softened fluororesin is readily scraped and transfers from the heating member to a heating subject when the member contacts the subject, which increases the amount of a liquid composition transferred from the subject to the member.

However, when fluororesin attached to the concave portion as in the present embodiment, the fluororesin remains on a heating member even if the heating member having a high surface temperature contacts a heating subject. That is, the transfer mentioned above from the heating subject does not occur.

It is preferable that the temperature of the surface layer of a heating member be preferably 50 degrees C. or higher, more preferably 70 degrees C. or higher, furthermore preferably 100 degrees C. or higher, and particularly preferably 110 degrees C. or higher. A surface layer having a temperature of 50 degrees C. or higher enhances the effect of preventing the transfer from the heating subject. The temperature of the surface layer of a heating member is preferably 200 degrees C. or lower and more preferably 150 degrees C. or lower.

As long as the fluororesin attaches to the concave portion of a supporting layer, it does not matter whether the fluororesin attaches to the non-concave portion of the supporting layer. That is, the fluororesin may or may not attach the non-concave portion. It is preferable that the area where the fluororesin is present in a unit area of the concave portion be larger than that in a unit area of the non-concave portion.

The area where the fluororesin is present, the fluororesin area, means the area where the fluororesin is present in an image in a plan view of a surface layer. The fluororesin area can be obtained in the following manner. Mapping a fluorine component is conducted in the surface layer of a heating member. One way of mapping a fluorine component is subjecting a cross section of a surface layer to elemental analysis using an in-built EDS system, Phenom ProX, manufactured by Phenom-World By. Next, from the data obtained using a software, ProSuite, the fluororesin area in a unit area of the concave portion and the fluororesin area in a unit area of the non-concave portion are calculated. From the data obtained at five arbitrary sites for each of the concave portions and the non-concave portions in the same manner, the average of each of the fluororesin areas in a unit area of the concave portion and the fluororesin areas in a unit area of the non-concave portion is calculated. The fluorine atom concentration of the region where a fluorine component is present is 1 percent or more.

The depth of the concave portion of a supporting layer is preferably from 0.2 to 2.0 μm, more preferably from 0.4 to 1.9 μm, and furthermore preferably from 1.1 to 1.6 μm. A depth in the region mentioned above minimizes the amount of fluororesin scraped off. The depth of a concave portion in the present disclosure represents the length of the longest normal drawn from the straight line linking the end points of the concave portion to the surface of a supporting layer as indicated by the arrow in FIG. 1.

The concave portion in a supporting layer has fluororesin attached regions and fluororesin non-attached regions, typically regions where the supporting layer is exposed, in a plan view obtained by taking a picture of the concave portion. It is preferable that at least one of the non-attached regions have an area of from 0.01 to 0.03 $\mu m^2$ and more preferable that at least two of the non-attached regions have an area of from 0.01 to 0.03 $\mu m^2$. When at least one of the non-attached regions has an area of from 0.01 to 0.03 $\mu m^2$, it reduces an area of a heating subject vacuum-attached to fluororesin, thereby preventing the component derived from a liquid composition from transferring from the heating subject to a heating member.

The fluororesin non-attached area can be obtained in the following manner. Mapping of aluminum component is conducted first in a concave portion. One way of mapping an aluminum component is elemental analysis using an in-built EDS system, Phenom ProX, manufactured by Phenom-World BV. Next, the area of each of non-attached regions is calculated from data obtained using a software, ProSuite. The measuring area at calculation is, for example, 10 μm×8 μm.

The way of obtaining at least one non-attached region having an area of from 0.01 to 0.03 $\mu m^2$ is not particularly limited. One way of manufacturing such an area is to dip a member on which a supporting layer is formed in a liquid dispersion containing fluororesin particles to attach the fluororesin to the member followed by polishing the surface of the member with a soft non-woven fabric having a poor absorbency. The non-woven fabric is preferably like a fluororesin fiber sheet, which is free of fiber remaining on the surface of a member. The area of a non-attached region is relatively small. This is because the area corresponds to gaps created among fluororesin particles since the fluororesin attached to a concave portion partially maintains the form of manufactured fluororesin particles. Non-attached regions satisfying the area specified above are thus not formed if fluororesin particles are attached by spraying a liquid dispersion containing the particles instead of dipping as described above. The non-attached regions are not formed because the dispersibility of fluororesin particles inferentially deteriorates during spraying in comparison with dipping. It is not also possible to form non-attached regions satisfying the area by a post-treatment for forming a uniform fluororesin layer by merging fluororesin particles attached to a supporting layer.

The supporting layer preferably has a thickness of from 25.0 to 35.0 μm. A supporting layer having a thickness of from 25.0 to 35.0 μm minimizes a variation of emissivity of a heating member and a variation of the measuring values by a temperature measuring member. One way of obtaining the thickness of a supporting layer is as follows. Each of a sulfur component, an aluminum component, and an oxygen component is subjected to mapping in a cross section of a heating member. One way of mapping a sulfur component, an aluminum component, and an oxygen component is elemental analysis using an in-built EDS system, Phenom ProX, manufactured by Phenom-World By.

A region where all of the sulfur component, the aluminum component, and the oxygen component are detected is determined as a supporting layer. A normal is drawn from the surface of the supporting layer toward the substrate to obtain its length. The length of each normal at ten arbitrary sites in the supporting layer is obtained in the same manner. The average of the lengths is determined as the thickness of the supporting layer.

The supporting layer mentioned above contains sulfuric acid anodized aluminum, which is preferable because it is possible to enhance the hardness of the layer in comparison with a layer containing aluminum oxide manufactured by treatment other than sulfuric acid anodized aluminum treatment. A heating member having this supporting layer thus becomes hard. A heating member preferably has a Vickers hardness of from 400 to 500 Hv. A Vickers hardness of from 400 to 500 Hv minimizes abrasion of the rough surface of a heating member, which provides a spacer effect of preventing fluororesin attached to a concave portion from detaching when the heating member contacts a heating subject. Vickers hardness can be measured according to the testing method in JISZ 2244 format.

Fluororesin

Fluororesin can enhance lubricity between a heating member and a heating subject. As described above, fluororesin attaches to the concave portion of a supporting layer and may attach to the non-concave portion as well.

Examples of the fluororesin include, but are not limited to, a tetrafluoroethylene-perfluoroalkylvinyl ether copolymer, PFA, melting point of from 300 to 310 degrees C., polytetrafluoroethylene, PTFE, melting point of from 330 degrees C., a tetrafluoroethylene-hexafluoropropylene copolymer, FEP, melting point of from 250 to 280 degrees C., an ethylene-tetrafluoroethylene copolymer, ETFE, melting point of from 260 to 270 degrees C., polyvinylidene fluoride, PVDF, melting point of from 160 to 180 degrees C., polychlorotrifluoroethylene, PCTFE, melting point of 210 degrees C., a tetrafluoroethylene-hexafluoropropylene-perfluoroalkylvinyl ether copolymer, EPE, melting point of from 290 to 300 degrees C.), and a mixture containing these copolymers. Of these, PTFE is preferable.

The rate of area of fluororesin present is preferably from 15 to 30 percent to the entire area of a surface layer. A rate of 15 percent of greater prevents the component derived from a liquid composition from transferring from a heating subject to a heating member. When the rate is 30 percent or less, fluororesin crushes and increases tackiness over the use of a heating member in an extended period of time, which minimizes the transfer mentioned above from a heating subject. The rate of a fluororesin area can be obtained in the following manner. Mapping a fluorine component is conducted in the surface layer of a heating member. One way of mapping a fluorine component is subjecting a cross section of a surface layer to elemental analysis using an in-built EDS system, Phenom ProX, manufactured by Phenom-World By. Next, the rate of area in a region where a fluorine component is present is calculated from data obtained using a software, ProSuite. The rate of area in a region where a fluorine component is present is calculated in the same manner for five arbitrary sites. The average is determined as the rate. In any region where a fluorine component is present, the fluorine atom concentration is 1 percent or greater. The measuring area at calculation is, for example, 100 μm×100 μm.

Substrate

The substrate in a heating member is situated on the side where the surface layer is not in contact with a heating subject. It is preferable to form a supporting layer by subjecting a substrate to sulfuric acid anodized aluminum treatment when manufacturing a heating member. It is, therefore, preferable for a substrate to contain aluminum. It is more preferable for a substrate to contain magnesium in addition to aluminum. Aluminum oxide grows in a pillar form when aluminum is subjected to sulfuric acid anodized aluminum treatment. Magnesium contained disturbs the growing direction of aluminum oxide, which causes stress in aluminum oxide, resulting in forming a very rough surface of a supporting layer. It is more preferable for a substrate to contain silicon in addition to aluminum. Silicon in a substrate disturbs the growing direction of aluminum oxide like magnesium, which causes stress in aluminum oxide, resulting in forming a very rough surface of a supporting layer. As described above, a very rough surface of a supporting layer formed provides a spacer effect of minimizing the detachment of fluororesin resin attached to a concave portion when a heating member and a heating subject are brought into contact with each other. Components derived from liquid compositions on a heating subject are efficiently prevented from transferring from the heating subject to a heating member.

The form of a substrate is not particularly limited. It is, in one example, a long rod-like metal member, and, in another example, has a roller-like form such as a solid or hollow cylinder having a circular cross section. A heating member having a substrate having such a form can be a heating roller. In the case of a roller substrate, the diameter of the cross section of the heating member is preferably from 50 to 600 mm. A diameter of 50 mm or greater lowers the pressure per unit area between a heating member and a heating subject, preventing a component derived from the liquid composition of the subject from transferring from the subject to the member. Conversely, a diameter of 600 mm or less prevents excessive attachment between a heating member and a heating subject, thereby minimizing the transfer from the subject.

Heating Device

The heating device in a heating member applies heat to a heating subject via the surface layer. One of the heating devices has the minimum length between a particular position of the heating device and the surface layer shorter than the minimum length between the particular position and a heating subject. In the case of a roller-like heating device, the heating device is disposed in a roller-like substrate and applies heat to a heating subject via the substrate and the surface layer. The heating device is not particularly limited and it includes a known device such as a heater and a device for generating heated wind.

Temperature Measuring Member

The temperature measuring member in a drying device measures the temperature of the region of a heating member in a non-contact manner that has contacted a heating subject. The temperature measuring member receives infra-red emitted from a heating member and converts it into temperature. Since the drying device can detect the temperature of a heating member by the temperature measuring member, it can detect the falling of the temperature when the temperature lowers upon the contact between the heating member and a heating subject and supply heat while substantially maintaining the temperature of the heating member by feedback control.

Figure 2:
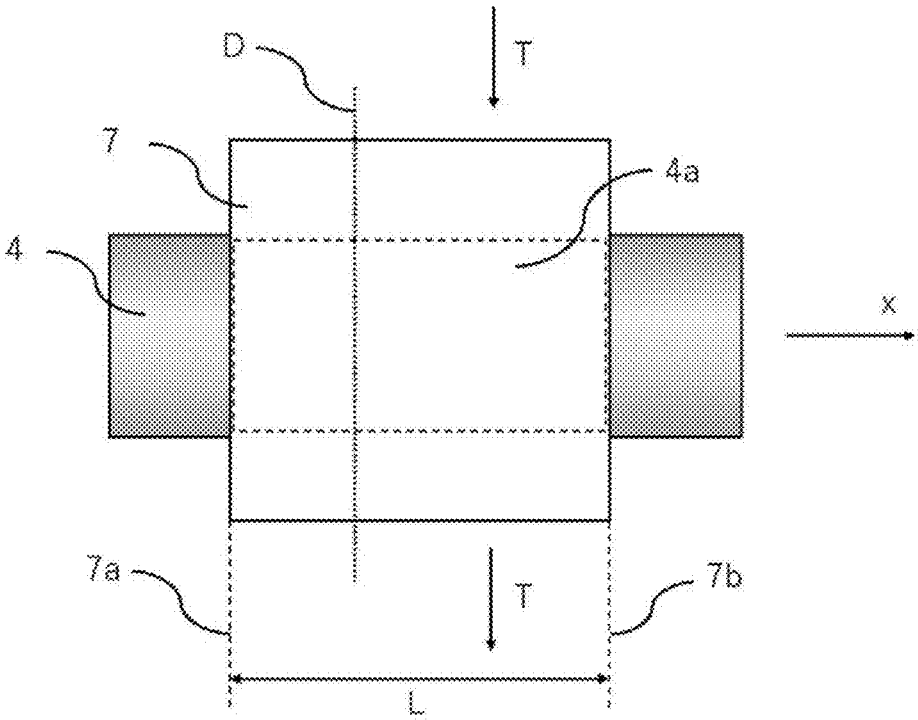
FIG. 2 is a schematic diagram illustrating an example of a heating member and a heating subject in contact with each other viewed from the surface on which the heating member contacts the heating subject.
Figure 3:
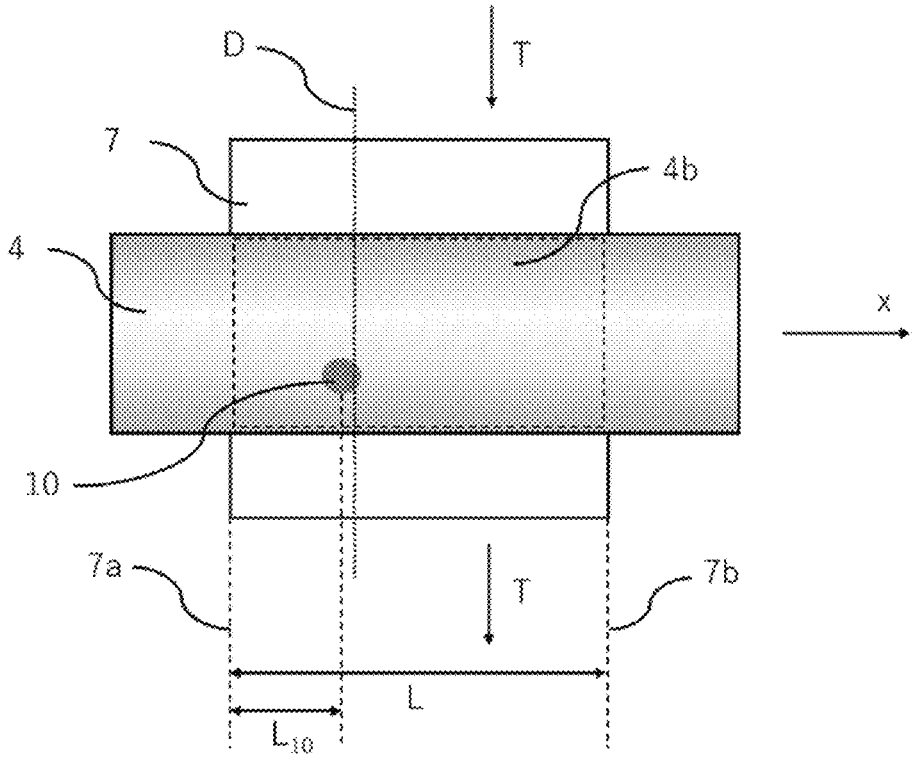
FIG. 3 is a schematic diagram illustrating an example of a heating member and a heating subject in contact with each other viewed from the surface on which the heating member does not contact the heating subject.
Figure 4:
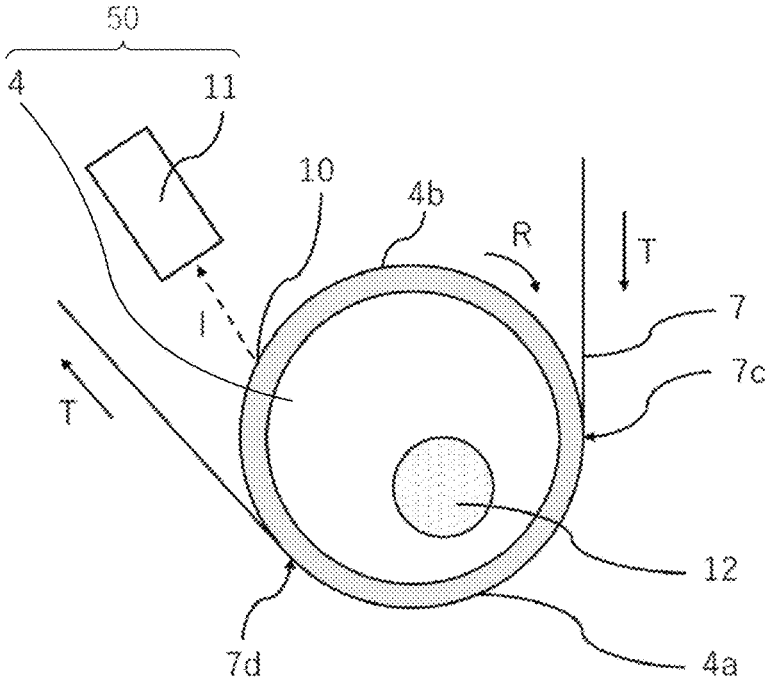
FIG. 4 is a diagram illustrating a cross sectional view at the dotted line Din FIGS. 2 and 3.

The temperature measuring member measures the temperature at the temperature measuring point on the surface of a heating member. The temperature measuring point is described with reference to FIGS. 2 to 4. FIG. 2 is a schematic diagram illustrating an example of a heating member and a heating subject in contact with each other viewed from the surface on which the heating member contacts the heating subject. FIG. 3 is a schematic diagram illustrating an example of a heating member and a heating subject in contact with each other viewed from the surface on which the heating member does not contact the heating subject. FIG. 4 is a diagram illustrating a cross sectional view at the dotted line D in FIGS. 2 and 3.

As illustrated in FIGS. 2 to 4, a heating member 4 conveys a heating subject 7 to a conveyance direction T in a contact manner while rotating in a rotation direction R. It simultaneously transfers heat supplied from a heating device 12 to the heating subject 7 via the surface layer. As illustrated in FIG. 4, the heating member 4 starts contacting the heating subject 7 at a contact starting point 7*c* and ends contacting the heating subject 7 at a separation starting point 7*d*. The heating member 4 rotates against the heating subject 7 in a contact manner. It includes a region 4*a* illustrated in FIG. 2 which is in contact with the heating subject 7, the region from the contact starting point 7*c* to the separation starting point 7*d* along the rotation direction R illustrated in FIG. 4, and a region 4*b* illustrated in FIG. 3, the region from the separation starting point 7*d* to the contact starting point 7*c* along the rotation direction R illustrated in FIG. 4 which is not in contact with the heating subject 7 at the position illustrated in FIG. 4 after contacting the heating subject 7.

As illustrated in FIGS. 3 and 4, a temperature measuring point 10 is present at the region 4*b* of the heating member 4 which has contacted the heating subject 7. As illustrated in FIG. 4, a temperature measuring member 11 receives an infra-red I emitted from the temperature measuring point 10 to measure the temperature at the temperature measuring point 10. Since the temperature measuring point 10 is present at the region 4*b* of the heating member 4 which has contacted the heating subject 7, the temperature difference ΔT between the temperature measured by the temperature measuring member 11 and the real temperature of the heating member 4 is smaller than a case in which a temperature measuring point of the heating member 4 is present outside the heating subject 7. It is, therefore, possible to supply heat while substantially maintaining the temperature of the heating member which lowers upon contact with the heating subject 7. In other words, the feedback control mentioned above can be conducted precisely.

As illustrated in FIG. 3, the temperature measuring point 10 is situated somewhere between one end 7*a* and an other end 7*b* in the region 4*b* that has contacted the heating subject 7. A distance (length $L_{10}$) from the one end 7*a* of the region 4*b* to the temperature measuring point 10 along a perpendicular direction x to the conveyance direction T of the heating subject 7 is from 30 to 70 percent of a distance (length L) from the one end 7*a* to the other end 7*b* along the perpendicular direction x. When the $L_{10}$ is from 30 to 70 percent of the L, the temperature difference ΔT decreases, which makes it possible to supply heat while substantially maintaining the temperature of the heating member which lowers upon contact with the heating subject 7. In other words, the feedback control mentioned above can be conducted more precisely. The one end 7*a* and the other end 7*b* of the region 4*b* are continuous boundary portions along the conveyance direction T excluding the contact starting point 7*c* and the separation starting point 7*d* as illustrated in FIG. 4.

The temperature measuring point 10 is preferably present closer to the separation starting point 7*d* than to the contact starting point 7*c* as illustrated in FIG. 4. When the temperature measuring point 10 is closer to the separation starting point 7*d* than to the contact starting point 7*c*, the temperature difference ΔT decreases, which makes it possible to supply heat while substantially maintaining the temperature of the heating member which lowers upon contact with the heating subject 7. In other words, the feedback control mentioned above can be conducted more precisely. In the present disclosure, when the temperature measuring point 10 is closer to the separation starting point 7*d* than to the contact starting point 7*c*, the position of the temperature measuring point 10 is described as "downstream", when the temperature measuring point 10 is closer to the contact starting point 7*c* than to the separation starting point 7*d*, the position of the temperature measuring point 10 is described as "upstream".

The temperature measuring member 11 measures the temperature of the heating member 4 in a non-contact manner as illustrated in FIG. 4. If the temperature measuring member 11 contacts the heating member 4, it may damage the surface of the heating member 4 as the heating member 4 conveys the heating subject 7 by rotation. The heating member 4 is free of scars because it does not contact the temperature measuring member 11.

Figure 6:
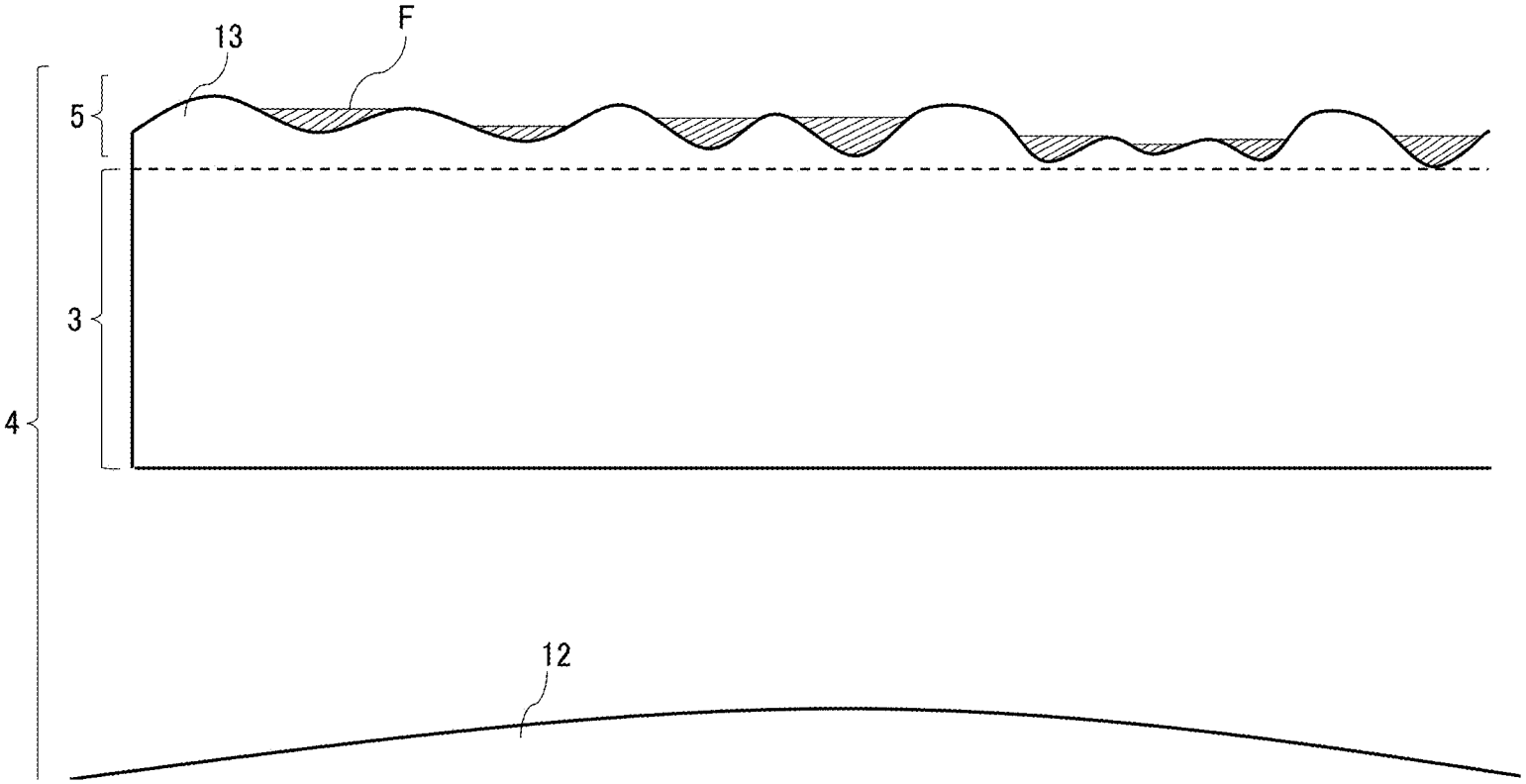
FIG. 6 is a diagram illustrating an example of the heating member in the drying device according to an embodiment of the present invention.

FIG. 6 is a diagram illustrating the heating member 4. The heating member 4 includes a substrate 3, a surface layer 5 disposed on the substrate 3 and brought into contact with the heating subject 7, and a heating device 12 for applying heat to the subject via the surface layer 5. The surface layer 5 includes a supporting layer 13 and the fluororesin F.

Printing Device

The printing device of the present embodiment includes an applying device for applying a liquid composition to a heating subject and a drying device including a heating member for conveying and heating the heating subject in a contact manner on which a liquid composition has been applied, the heating member including a substrate, a surface layer disposed on the substrate, the surface layer including a supporting layer having sulfuric acid anodized aluminum film having concave portions and non-concave portions and a fluororesin attached to the concave portions; and a heating device configured to heat the heating subject via the surface layer; and a temperature measuring member for measuring the temperature at a position in the region of the heating member that has contacted the heating subject.

The drying device can be the same as the drying device described above.

Figure 5:
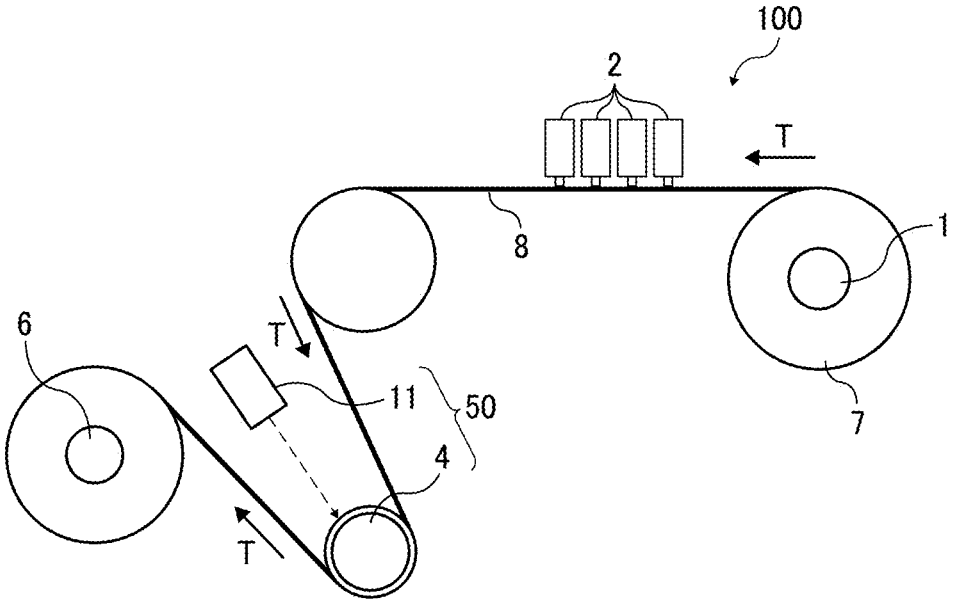
FIG. 5 is a schematic diagram illustrating a printing device using continuous paper.

The printing device will be described with reference to FIG. 5. FIG. 5 is a schematic diagram illustrating an example of a printing device using continuous paper. A printing device 100 illustrated in FIG. 5 includes a heating subject supplying device 1, a liquid composition applying device 2, a heating member 4, and a heating subject retrieving device 6. The printing device 100 includes a drying device 50, which may be integrated into or separated from the printing device 100.

Heating Subject Supplying Device

The heating subject supplying device 1 supplies the heating member 7 wound into a roll form by rotational driving to a conveyance path 8 in the printing device 100. The conveyance direction of the heating subject 7 in the conveyance path 8 is indicated by the arrows T.

The heating subject supplying device 1 adjusts the rotational driving to convey the heating subject 7 at a high speed of 50 m/min or greater.

The heating subject 7 has a sheet-like form continuously extending in the conveyance direction T of the printing device 100, specifically, a printing medium such as continuous paper. Examples of the continuous paper include, but are not limited to, roll paper wound into a roll form, and regularly folded fanfold paper. The heating subject 7 is conveyed along the conveyance path 8, which extends between the heating subject supplying device 1 and the heating subject retrieving device 6. The length of the heating subject 7 in the conveyance direction T is at least longer than the length of the conveyance path 8 between the heating subject supplying device 1 and the heating subject retrieving device 6. In order to convey the heating subject 7 continuously extending in the conveyance direction T of the printing device 100, a high tension is applied between the heating subject 7 between the heating subject supplying device 1 and the heating subject retrieving device 6.

Liquid Composition Applying Device

The liquid composition applying device 2 is an inkjet discharging head including nozzle arrays, each including nozzles. The nozzles are disposed to discharge ink toward the conveyance path 8 of the heating subject 7. The liquid composition applying device 2 sequentially discharges color inks of magenta (M), cyan (C), yellow (Y), and black (K) to the heating subject 7. The colors of the inks discharged are not limited to these colors, and may be, for example, white, gray, silver, gold, green, blue, orange, or violet.

This embodiment describes an example in which the liquid composition is ink. Alternatively, another liquid composition may be used. Examples of the liquid composition include, but are not limited to, ink, a pre-processing solution applied to aggregate coloring material in ink, a post-processing solution applied to protect the surface of applied ink, a liquid dispersion of inorganic particles such as metal particles for forming electric circuits, and appropriate mixtures or overlapped liquid of the foregoing.

This embodiment describes an example of applying the liquid composition to the heating subject 7 with an inkjet discharging head. Alternatively, it is possible to apply the liquid composition with another device. Specific examples include, but are not limited to, various known methods such as spin coating, spray coating, gravure roll coating, reverse roll coating, and bar coating.

Heating Member

The heating member 4 is a cylindrical or hollow cylindrical roller. It changes the conveyance direction T of the heating subject 7 while conveying the heating subject 7.

In the printing device 100, the heating subject supplying device 1 conveys the heating subject 7 at 50 m/min or more. A high pressure applies to between the contact member 4 and the heating subject 7 when the heating member 4 changes the conveyance direction of the heating subject 7 as illustrated in FIG. 5 while conveying the heating subject 7 at a high speed. The heating subject 7 readily scrapes fluororesin under this high pressure so that the component derived from a liquid composition tends to transfer from the heating subject 7 to the heating member 4 over time. However, this transfer is prevented in the present disclosure because fluororesin attached to the concave portions remains on the heating member 4.

As illustrated in FIG. 5, a large tension applies to the heating subject 7 between the heating member supplying device 1 and the heating subject retrieving device 6 while the printing device 100 conveys the heating subject 7 continuously extending in the conveyance direction T of the printing device 100. When the heating member 4 changes the conveyance direction T of the heating subject 7 under such a high tension as illustrated in FIG. 5, a high pressure applies to between the heating member 4 and the heating subject 7. The heating subject 7 readily scrapes fluororesin under this high pressure so that the component derived from a liquid composition tends to transfer from the heating subject 7 to the heating member 4 over time. However, this transfer is prevented in the present disclosure because fluororesin attached to the concave portions remains on the heating member 4.

Heating Subject Retrieving Device

The heating subject retrieving device 6 rotates and winds up the heating subject 7 having images formed with the liquid composition thereon, which is stored in a roll form.

Printing Method

The printing method of the present embodiment includes applying a liquid composition to a heating subject, heating the heating subject on which the liquid composition has been applied in a contact manner while conveying the heating subject, and measuring the temperature at a position in the region in a heating member that has contacted the heating subject in a non-contact manner. The method may furthermore optionally include other steps.

Liquid Composition Application

In the liquid composition application, a liquid composition such as ink is applied to the heating subject 7 supplied from the heating subject supplying device 1. A liquid composition applied region is formed on the heating subject 7 in this process.

Heating

In the heating, the heating member 4 is brought into contact with the heating subject 7 onto which the liquid composition has been applied to heat and convey the heating subject 7. It is preferable to heat the heating subject 7 to a degree that the heating subject 7 does not feel tacky.

Temperature Measuring

In the temperature measuring, the temperature of the region of the heating member 4 that has contacted the heating subject 7 is measured in a non-contact manner, which is preferably conducted with the heating at the same time.

Liquid Composition

The liquid composition applied to a heating subject is not particularly limited. Examples include, but are not limited to, ink, a pre-processing solution applied to aggregate a coloring material contained in ink, a post-processing solution applied to protect the surface of applied ink, and a liquid dispersion containing inorganic particles such as metal particles for forming electric circuits and others. These liquid compositions may be appropriately used in accordance with known formulations. Ink is used as a liquid composition in the following.

Ink

Hereinafter, raw materials for ink, such as organic solvent, water, coloring material, resin, wax, and additives, will be described.

Organic Solvent

The organic solvent is not particularly limited and water-soluble organic solvents can be used. It includes, but are not limited to, polyhydric alcohols, ethers such as polyhydric alcohol alkylethers and polyhydric alcohol arylethers, nitrogen-containing heterocyclic compounds, amides, amines, and sulfur-containing compounds.

Specific examples of polyolhydric alcohols include, but are not limited to, ethylene glycol, diethylene glycol, 1,2-propanediol, 1,3-propanediol, 1,2-butanediol, 1,3-butanediol, 1,4-butane diol, 2,3-butanediol, 3-methyl-1,3-butanediol, triethylene glycol, polyethylene glycol, polypropylene glycol, 1,2-pentanediol, 1,3-pentanediol, 1,4-pentanediol 2,4-pentanediol, 1,5-pentanediol, 1,2-hexanediol, 1,6-hexanediol, 1,3-hexanediol, 2,5-hexanediol, 1,5-hexanediol, glycerin, 1,2,6-hexanetriol, 2-ethyl-1,3-hexanediol, ethyl-1,2,4-butanetriol, 1,2,3-butanetriol, 2,2,4-trimethyl-1,3-pentanediol, and petriol.

Specific examples of the polyhydric alcohol ethers include, but are not limited to, ethylene glycol monoethyl ether, ethylene glycol monobutyl ether, diethylene glycol monomethyl ether, diethylene glycol monoethyl ether, diethylene glycol monobutyl ether, tetraethylene glycol monomethyl ether, and propylene glycol monoethyl ether.

Specific examples of the polyol aryl ethers include, but are not limited to, ethylene glycol monophenyl ether and ethylene glycol monobenzyl ether.

Specific examples of the nitrogen-containing heterocyclic compound include, but are not limited to, 2-pyrrolidone, N-methyl-2-pyrrolidone, N-hydroxyethyle-2-pyrrolidone, 1,3-dimethyl-2-imidazoline, ε-caprolactam, and γ-butylolactone.

Specific examples of the amide include, but are not limited to, formamide, N-methylformamide, N,N-dimethylformamide, 3-methoxy-N,N-dimethyl propionamide, and 3-butoxy-N,N-dimethyl propionamide.

Specific examples of amines include, but are not limited to, monoethanolamine, diethanolamine, and triethylamine.

Specific examples of the sulfur-containing compounds include, but are not limited to, dimethyl sulphoxide, sulfolane, and thiodiethanol.

Specific examples of the other organic solvents include, but are not limited to, propylene carbonate and ethylene carbonate.

It is preferable to use an organic solvent having a boiling point of 250 or lower degrees C., which serves as a humectant and imparts a good drying property at the same time.

Polyol compounds having eight or more carbon atoms and glycol ether compounds are also suitably used as the organic solvent. Specific examples of the polyol compounds having eight or more carbon atoms include, but are not limited to, 2-ethyl-1,3-hexanediol and 2,2,4-trimethyl-1,3-pentanediol.

Specific examples of the glycolether compounds include, but are not limited to, polyhydric alcohol alkylethers such as ethylene glycol monoethylether, ethylene glycol monobutylether, diethylene glycol monomethylether, diethylene glycol monoethylether, diethylene glycol monobutylether, tetraethylene glycol monomethylether, and propylene glycol monoethylether and polyhydric alcohol arylethers such as ethylene glycol monophenylether and ethylene glycol monobenzylether.

In particular, if a resin is used as the ink composition, N,N-dimethyl-β-buthoxypropionamide, N,N-dimethyl-β-ethoxypropionamide, 3-ethyl-3-hydroxymethyloxetane, and propylene glycol monomethylether are preferable. These can be used alone or in combination. Of these, amide solvents such as 3-buthoxy-N,N-dimethyl propionamide and 3-methoxy-N,N-dimethyl propionamide are particularly preferable to promote film-forming property of a resin and demonstrate better abrasion resistance.

The organic solvent preferably has a boiling point of from 180 to 250 degrees C. When the boiling point is 180 degrees C. or higher, the evaporation speed during drying can be suitably controlled, leveling is sufficiently conducted, surface roughness is reduced, and gloss is improved. Conversely, when the boiling point is higher than 250 degrees C., drying performance is not good so that drying takes a longer time. According to the advancement of print technologies, the time spent for drying becomes a rate limiting factor so that short drying time is favorable.

The proportion of the organic solvent in ink is not particularly limited and it can be suitably selected to suit to a particular application. It is preferably from 10 to 60 percent by mass and more preferably from 20 to 60 percent by mass to enhance the drying property and discharging reliability of the ink.

The proportion of the amide solvent in the ink is preferably from 0.05 to 10 percent by mass and more preferably from 0.1 to 5 percent by mass.

Water

The proportion of water in the ink is not particularly limited and it can be suitably selected to suit to a particular application. It is preferably from 10 to 90 percent by mass and more preferably from 20 to 60 percent by mass to enhance the drying property and discharging reliability of ink.

Coloring Material

The coloring material has no particular limitation and includes materials such as a pigment and a dye.

The pigment includes an inorganic pigment or organic pigment. These can be used alone or in combination. Also, mixed crystals are usable as the pigments.

Examples of the pigments include, but are not limited to, black pigments, yellow pigments, magenta pigments, cyan pigments, white pigments, green pigments, orange pigments, and gloss or metallic pigments of gold, silver, and others.

Carbon black manufactured by known methods such as contact methods, furnace methods, and thermal methods can be used as the inorganic pigment in addition to titanium oxide, iron oxide, calcium carbonate, barium sulfate, aluminum hydroxide, barium yellow, cadmium red, and chrome yellow.

Specific examples of the organic pigment include, but are not limited to, azo pigments, polycyclic pigments (e.g., phthalocyanine pigments, perylene pigments, perinone pigments, anthraquinone pigments, quinacridone pigments, dioxazine pigments, indigo pigments, thioindigo pigments, isoindolinone pigments, and quinophthalone pigments), dye chelates (e.g., basic dye type chelates and acid dye type chelates), nitro pigments, nitroso pigments, and aniline black. Of those pigments, pigments having good affinity with solvents are preferable. Hollow resin particles and hollow inorganic particles can also be used.

Specific examples of the pigments for black include, but are not limited to, carbon black (C.I. Pigment Black 7) such as furnace black, lamp black, acetylene black, and channel black, metals such as copper, iron (C.I. Pigment Black 11), and titanium oxide, and organic pigments such as aniline black (C.I. Pigment Black 1).

Specific examples of the pigments for color include, but are not limited to, C.I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 138, 150, 153, 155, 180, 185, and 213; C.I. Pigment Orange 5, 13, 16, 17, 36, 43, and 51, C.I. Pigment Red 1, 2, 3, 5, 17, 22, 23, 31, 38, 48:2 {Permanent Red 2B(Ca)}, 48:3, 48:4, 49:1, 52:2, 53:1, 57:1 (Brilliant Carmine 6B), 60:1, 63:1, 63:2, 64:1, 81, 83, 88, 101 (rouge), 104, 105, 106, 108 (Cadmium Red), 112, 114, 122 (Quinacridone Magenta), 123, 146, 149, 166, 168, 170, 172, 177, 178, 179, 184, 185, 190, 193, 202, 207, 208, 209, 213, 219, 224, 254, and 264; C.I. Pigment Violet 1 (Rhodamine Lake), 3, 5:1, 16, 19, 23, and 38; C.I. Pigment Blue 1, 2, 15 (Phthalocyanine Blue), 15:1, 15:2, 15:3, 15:4, (Phthalocyanine Blue), 16, 17:1, 56, 60, and 63, C.I. Pigment Green 1, 4, 7, 8, 10, 17, 18, and 36.

The dye is not particularly limited and includes, for example, acidic dyes, direct dyes, reactive dyes, basic dyes. These can be used alone or in combination.

Specific examples of the dye include, but are not limited to, C.I. Acid Yellow 17, 23, 42, 44, 79, and 142, C.I. Acid Red 52, 80, 82, 249, 254, and 289, C.I. Acid Blue 9, 45, and 249, C.I. Acid Black 1, 2, 24, and 94, C. I. Food Black 1 and 2, C.I. Direct Yellow 1, 12, 24, 33, 50, 55, 58, 86, 132, 142, 144, and 173, C.I. Direct Red 1, 4, 9, 80, 81, 225, and 227, C.I. Direct Blue 1, 2, 15, 71, 86, 87, 98, 165, 199, and 202, C.I. Direct Black 19, 38, 51, 71, 154, 168, 171, and 195, C.I. Reactive Red 14, 32, 55, 79, and 249, and C.I. Reactive Black 3, 4, and 35.

The proportion of the coloring material in ink is preferably from 0.1 to 15 percent by mass and more preferably from 1 to 10 percent by mass to enhance the image density, fixability, and discharging stability.

Ink can be obtained by dispersing a pigment. The pigment can be dispersed in ink by a method of introducing a hydrophilic functional group into a pigment to prepare a self-dispersible pigment, a method of coating the surface of a pigment with a resin followed by dispersion, or a method of using a dispersant to disperse a pigment, and other methods.

One way of preparing a self-dispersible pigment by introducing a hydrophilic functional group into a pigment is to add a functional group such as a sulfone group and carboxyl group to a pigment (e.g., carbon) to disperse the pigment in water.

One way of dispersing a pigment by coating the surface of the pigment with resin is to encapsulate pigment particles in microcapsules for dispersion in water. This is also referred to as a resin-coated pigment. In this case, all the pigments to be added to ink are not necessarily entirely coated with a resin. Pigments never or partially coated with a resin may be dispersed in the ink.

As the dispersant for use in the dispersion method described above, a known dispersant of a small or large molecular weight, typically a surfactant, is suitable.

It is possible to select an anionic surfactant, a cationic surfactant, a nonionic surfactant, an amphoteric surfactant, or others depending on a pigment.

A nonionic surfactant (RT-100, manufactured by TAKEMOTO OIL & FAT CO., LTD.) and a formalin condensate of naphthalene sodium sulfonate are suitably used as the dispersant.

Those can be used alone or in combination.

Pigment Dispersion

The ink can be obtained by mixing a pigment with materials such as water and an organic solvent. It is also possible to mix a pigment with water, a dispersant, and other substances to prepare a pigment dispersion and thereafter mix the pigment dispersion with materials such as water and an organic solvent to manufacture an ink.

The particle size of pigment dispersion is adjusted by mixing or dispersing with water, a pigment, a pigment dispersant, and other optional components. It is good to use a dispersing device for dispersion.

The particle diameter of the pigment in the pigment dispersion has no particular limit. For example, the maximum frequency is preferably from 20 to 500 nm and more preferably from 20 to 150 nm in the maximum number conversion to improve dispersion stability of the pigment and ameliorate discharging stability and the image quality such as image density. The particle diameter of the pigment can be analyzed using a particle size analyzer (Nanotrac Wave-UT151, manufactured by MicrotracBEL Corp).

The proportion of the pigment in the pigment dispersion is not particularly limited and can be suitably selected to suit a particular application. It is preferably from 0.1 to 50 percent by mass and more preferably from 0.1 to 30 percent by mass to enhance the discharging stability and image density.

It is preferable that the pigment dispersion be filtered with an instrument such as a filter and a centrifuge to remove coarse particles followed by degassing.

Resin

The type of the resin contained in ink has no particular limit and can be suitably selected to suit to a particular application. It includes, but are not limited to, urethane resins, polyester resins, acrylic-based resins, vinyl acetate-based resins, styrene-based resins, butadiene-based resins, styrene-butadiene-based resins, vinylchloride-based resins, acrylic styrene-based resins, and acrylic silicone-based resins.

Resin particles made of such resins can be also used. It is possible to mix a resin emulsion in which such resin particles are dispersed in water as a dispersion medium with materials such as a coloring material and an organic solvent to obtain an ink. It is possible to use suitably-synthesized resin particles as the resin particle. Alternatively, the resin particle is procurable. The resin particle can be used alone or two or more type of the resin particles can be used in combination.

Of the above-described examples, urethane resin particles are used together with other resin particles in one example because urethane-resin-particle ink provides images having high tackiness, which degrades blocking resistance. However, such high tackiness of urethane resin particles enables formation of strong images and enhancement of fixing properties. Images formed with ink containing urethane resin particles having a glass transition temperature (Tg) of from −20 to 70 degrees C. have good tackiness and fixability.

Of the above-described resins, acrylic resin particles formed of acrylic resin have high discharging stability and are also inexpensive, so that they are widely used. However, since acrylic resin particles have low abrasion resistance, and hence are used together with elastic urethane resin particles in one example.

The volume average particle diameter (mean volume diameter) of the resin particle is not particularly limited and can be suitably selected to suit to a particular application. The mean volume diameter is preferably from 10 to 1,000 nm, more preferably from 10 to 200 nm, and particularly preferably from 10 to 100 nm to achieve good fixability and image robustness.

The mean volume diameter can be measured by using an instrument such as a particle size analyzer (Nanotrac Wave-UT151, manufactured by MicrotracBEL Corp.).

The proportion of the resin is not particularly limited and can be suitably selected to suit to a particular application. It is preferably from 1 to 30 percent by mass and more preferably from 5 to 20 percent by mass to an entire ink to secure fixability and storage stability of the ink.

The particle diameter of the solid portion in the ink has no particular limit and can be selected to suit to a particular application. The maximum frequency of the particle diameter of the solid portion in the ink is preferably from 20 to 1000 inn and more preferably from 20 to 150 nm in the maximum number conversion to enhance discharging stability and image quality such as image density. The solid content includes resin particles and particles of pigment and others. The particle diameter can be measured by using a particle size analyzer (Nanotrac Wave-UT151, manufactured by MicrotracBEL Corp).

Wax

Inclusion of wax in ink enhances abrasion resistance and the gloss degree can be enhanced when used in combination with a resin. The wax is preferably a polyethylene wax. The polyethylene wax can be procured. Specific examples include, but are not limited to, AQUACER 531 (manufactured by BYK Japan KK), Polyron P502 (manufactured by Chukyo Yushi Co., Ltd.), Aquapetro DP2502C (manufactured by TOYO ADL CORPORATION), and Aquapetro DP2401 (manufactured by TOYO ADL CORPORATION). These can be used alone or in combination.

The proportion of polyethylene wax to an entire ink is preferably from 0.05 to 2 percent by mass and more preferably from 0.05 to 0.5 percent by mass. A proportion of from 0.05 to 2 percent by mass enhances the abrasion resistance and glossiness. In addition, when the proportion is 0.45 percent by mass or less, ink particularly becomes good about the storage stability and discharging stability and it is suitable for inkjet printing.

Additive

The ink may further optionally include additives such as a surfactant, defoaming agent, preservative and fungicide, corrosion inhibitor, and pH regulator.

Heating Subject

The heating subject is not particularly limited, and may be selected from recording media such as normal paper, glossy paper, specialty paper, and cloth. In one example, the heating subject is particularly suitable for low-permeable printing media, also referred to as low-absorption printing media.

The low-permeable printing medium has a surface with low moisture permeability, absorbency, or adsorption property and includes a material having many hollow spaces inside that are not open to the outside. Examples of the low-permeable printing medium include, but are not limited to, coated paper for use in commercial printing and a printing medium like coated paper board having a middle layer and a back layer mixed with waste paper pulp.

Low-permeable printing media has a strong grip in comparison with plain paper so that a heating subject readily scrapes fluororesin so that the component derived from a liquid composition tends to transfer from the heating subject to the heating member over time. However, this transfer is prevented in the present disclosure because fluororesin attached to the concave portions remains on the heating member 4.

Low-Permeable Printing Medium

The low-permeable printing medium includes, for example, a substrate and a surface layer provided to at least one surface of the substrate. Also, the low-permeable printing medium includes a printing medium such as coated paper having other optional layers.

A printing medium including a substrate and a surface layer preferably has an amount of pure water transferred to the recording medium of from 2 to 35 $mL/m^2$ and more preferably from 2 to 10 $mL/m^2$ during a contact time of 100 ms as measured by a dynamic scanning absorptometer.

When the amount of ink and pure water transferred during a contact time of 100 ms is too small, beading tends to occur. When the amount is too large, the ink dot diameter tends to be smaller than desired after image forming.

The amount of pure water transferred to a printing medium is from 3 to 40 $mL/m^2$ and preferably from 3 to 10 $mL/m^2$ during a contact time of 400 m as measured by a dynamic scanning absorptometer.

When the amount during the contact time of 400 ms is small, drying becomes insufficient. When the amount is too much, the gloss of the image portion tends to be low after drying. The amount of pure water transferred to a printing medium during a contact time of 100 ms and 400 ms can be measured at the surface on which the surface layer is present.

This dynamic scanning absorptometer (KUGA, Shigenori, Dynamic scanning absorptometer (DSA); Journal of JAPAN TAPPI, published in May 1994, Vol. 48, pp. 88-92) can accurately measure the amount of liquid absorbed in an extremely short period of time. This dynamic scanning absorptometer automates the measuring utilizing the method of directly reading the absorption speed of liquid from moving of meniscus in a capillary, spirally scanning an imbibition head on a sample having a disc-like form, and measuring the required number of points on the single sample while automatically changing the scanning speed according to predetermined patterns.

The liquid supply head for a paper sample is connected with the capillary via a TEFLON® tube and the position of the meniscus in the capillary is automatically read by an optical sensor. Specifically, the transfer amount of pure water or ink can be measured using a dynamic scanning absorptometer (K350 Series D type, manufactured by Kyowa Seiko Inc.).

Each of the transfer amount during the contact time of 100 ms and 400 ms can be obtained by interpolation from the measuring results of the transfer amount in the proximity contact time of the contact time.

Substrate

There is no specific limitation to the selection of the substrate and it can be suitably selected to suit to a particular application. For example, paper mainly formed of wood fiber and a sheet material such as non-woven cloth mainly formed of wood fiber and synthetic fiber are usable.

There is no specific limit to the thickness of a substrate. The layer thickness thereof can be determined to suit to a particular application and preferably ranges from 50 μm to 300 μm. The mass of a substrate is preferably from 45 to 290 $g/m^2$.

Surface Layer

The surface layer contains a pigment, a binder, and other optional components such as a surfactant.

As the pigments, inorganic pigments or a combination of inorganic pigments and organic pigments can be used. Specific examples of the inorganic pigments include, but are not limited to, kaolin, talc, heavy calcium carbonate, light calcium carbonate, calcium sulfite, amorphous silica, titanium white, magnesium carbonate, titanium dioxide, aluminum hydroxide, calcium hydroxide, magnesium hydroxide, zinc hydroxide, and chlorite. The addition amount of the inorganic pigment is preferably 50 parts by mass or more based on 100 parts by mass of the binder.

Specific examples of the organic pigments include, but are not limited to, water-soluble dispersions of styrene-acrylic copolymer particles, styrene-butadiene copolymer particles, polystyrene particles, and polyethylene particles. The addition amount of the organic pigment is preferably from 2 to 20 parts by mass based on 100 parts by mass of all the pigments in the surface layer.

As the binder resin, aqueous resins are preferable. As the aqueous resins, at least one of water-soluble resins and water-dispersible resins are preferable. The water-soluble resin is not particularly limited and can be suitably selected to suit to a particular application. Examples thereof include polyvinyl alcohol, cation-modified polyvinyl alcohol, acetal-modified polyvinyl alcohol, polyester, and polyurethane.

The surfactant optionally contained in the surface layer is not particularly limited and can be suitably selected to suit to a particular application. Anionic active agents, cationic active agents, amphoteric active agents, and non-ionic active agent can be used.

The method of forming the surface layer is not particularly limited and can be suitably selected to suit to a particular application. For example, methods are utilized in which a liquid that forms the surface layer on a substrate is applied to the substrate or a substrate is dipped in a liquid that forms the surface layer. The attachment amount of the liquid forming the surface layer is not particularly limited and can be suitably selected to suit to a particular application. The attachment amount of the solid portion preferably ranges from 0.5 to 20 $g/m^2$ and more preferably from 1 to 15 $g/m^2$.

The terms of image forming, recording, and printing in the present disclosure represent the same meaning.

Also, recording media, media, and print substrates in the present disclosure have the same meaning unless otherwise specified.

Having generally described preferred embodiments of this disclosure, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples but is not limited thereto.

Preparation Example of Black Pigment Dispersion

A total of 20 g of carbon black, NIPEX 160, manufactured by Degussa, BET specific surface area of 150 $m^2/g$, average primary particle size of 20 nm, pH of 4.0, DBP absorption number of 620 g/100 g, 20 mmol of a compound represented by Chemical structure 1 below, and 200 mL of deionized highly pure water were mixed in a room-temperature environment with a Silverson mixer at 6,000 rpm to obtain a slurry.

When the slurry obtained had a pH higher than 4, 20 mmol of nitric acid was added. Thirty minutes later, 20 mmol of sodium nitrite dissolved in a minute amount of deionized highly pure water was slowly added to the mixture. The resulting mixture was heated to 60 degrees C. while being stirred to allow reaction for one hour. A reformed pigment was thus produced in which the compound represented by Chemical structure 1 illustrated below was added to the carbon black.

A dispersion of reformed pigment was obtained 30 minutes later by adjusting the pH to 10 with a NaOH aqueous solution. A dispersion containing a pigment bonded with at least one geminal-bisphosphonic acid group or a sodium salt of geminal bisphosphonic acid and deionized highly pure water were subjected to ultrafiltering using a dialysis membrane followed by ultrasonic wave dispersion to obtain self-dispersible black pigment dispersion having a bisphosphonic acid group as a hydrophilic group with a pigment solid concentration of 16 percent.

Chemical Structure 1

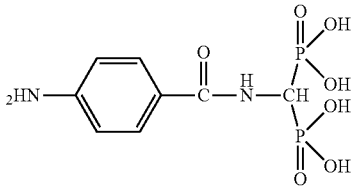

Preparation Example of Liquid Composition (Ink)

The black-pigment dispersion at 50.00 percent by mass with a pigment solid-content concentration of 16 percent, 2.22 percent by mass of polyethylene wax, AQUACER 531, non-volatile content of 45 percent by mass, manufactured by BYK Japan KK, 30.00 percent by mass of 3-ethyl-3-hydroxymethyloxetane, 10.0 percent by mass of propylene glycol monopropyl ether, 2.00 percent by mass of silicone-based surfactant, TEGO Wet 270, manufactured by TOMOE ENGINEERING CO., LTD., and deionized water as a balance were mixed. The mixture obtained was stirred for one hour followed by filtering through a membrane filter having an average pore size of 1.2 μm to obtain ink as a liquid composition.

Manufacturing Example of Printing Device

Example 1

The surface of a hollow aluminum roller substrate having a diameter of 80 mm, A5052, manufactured by MISUMI Group Inc. was subjected to anodizing aluminum in a sulfuric acid aqueous solution, referred to as sulfuric acid anodization. An electrode was mounted on one end of the hollow roller substrate, which was sunk in a sulfuric acid aqueous solution at 15 percent by mass adjusted to zero degrees C. Using a metal bar as an anode, the substrate was subjected to electrolysis at a current density of 1.0 A/dm$^2$ for 0.5 hours to precipitate sulfuric acid anodized aluminum film, a layer containing aluminum oxide with a sulfur component detected, to form a supporting layer having a thickness of 14 μm. The surface was rinsed with pure water and dipped in a liquid dispersion obtained by diluting a PTFE dispersion, Fluon, manufactured by AGC Inc., to 10 percent or less followed by one-time air drying. After the air drying, fluororesin fiber, Tommy Filec, manufactured by TOMOEGAWA CO., LTD., was pressed against the hollow roller for one-time polishing by wiping off while rotating the roller at 10 rpm. A heating source having an in-built halogen heater was disposed inside the hollow roller to prepare a heating member.

A radiation thermometer, FT-H10, manufactured by KEYENCE CORPORATION, was disposed as a temperature measuring member to measure the temperature of the region of the heating member that had contacted the heating subject in a non-contact manner to prepare a drying module as a drying device. The length $L_{10}$ from one end of the region to the temperature measuring point along the perpendicular direction to the conveyance direction of the heating subject was 10 percent of the length L from the one end to the other end of the region along the perpendicular direction. The temperature measuring point where the radiation thermometer measured the temperature was positioned closer to the contact starting point on the upstream side where the heating subject started contacting the heating member than to the separation starting point where the heating subject in contact with the heating member started separating from the heating member. The halogen heater in the heating member was subjected to feedback control for substantially maintaining the temperature of the heating member at 140 degrees C. based on the temperature acquired by the radiation thermometer A thermocouple, manufactured by KEYENCE CORPORATION, for measuring the real temperature of the heating member was disposed at the center of the region for Evaluation on Temperature Difference ΔT, which is described later.

A printing device for Example 1 was manufactured by incorporating the drying module into an inkjet printing system, RICOH Pro VC60000, manufactured by RICOH CO., LTD.

Examples 2 to 11

Printing devices of Examples 2 to 11 were manufactured in the same manner as in Example 1 except that the position of the temperature measuring member, the type of substrate, the time length of electrolysis, the method of attaching resin, the number of resin attaching, and the number of polishing the hollow roller were changed as shown in Table 1. In Table 1, when the temperature measuring point was closer to the separation starting point than to the contact starting point, the position of the temperature measuring point is written as "downstream". When the temperature measuring point was closer to the contact starting point than to the separation starting point, the position of the temperature measuring point is written as "upstream". "Sulfuric acid" in the type of the electrolyte used for electrolysis in Table 1 represents sulfuric acid aqueous solution. "Spraying" in how to attach resin of Examples 8 to 11 in Table 1 represents a method for forming a film by spraying a liquid dispersion obtained by diluting a PTFE dispersion, Fluon, manufactured by AGC Inc., to a solid content concentration of 10 percent or less to the hollow roller rotating at 10 rpm with a dual fluid nozzle.

Comparative Example 1

A printing device of Comparative Example 1 was manufactured in the same manner as in Example 1 except that the position of the temperature measuring member, the type of substrate, the time length of electrolysis, the method of attaching resin, the number of resin attaching, and the number of polishing the hollow roller were changed as shown in Table 2 and moreover, the type of electrolyte for electrolysis was changed from sulfuric acid aqueous solution to oxalic acid aqueous solution. "Oxalic acid" in the type of the electrolyte used for electrolysis in Table 2 represents oxalic acid aqueous solution.

Comparative Example 2

A printing device of Comparative Example 2 was manufactured in the same manner as in Example 1 except that the hollow aluminum roller, A5052, manufactured by MISUMI Group Inc., having a diameter of 80 mm, was used without a treatment.

Comparative Example 3

A printing device of Comparative Example 3 was manufactured in the same manner as in Example 1 except that the hollow aluminum roller, A5052, manufactured by MISUMI Group Inc., having a diameter of 80 mm, was covered with PFA tube having a thickness of 30 μm, manufactured by GUNZE LIMITED followed by shrinking the PFA tube by heating at 200 degrees C.

Comparative Example 4

A printing device of Comparative Example 4 was manufactured in the same manner as in Example 1 except that the length $L_{10}$ from one end of the region to the temperature measuring point along the perpendicular direction to the conveyance direction of the heating subject was changed to 110 percent to the length L from the one end to the other end along the direction, in other words, the temperature measuring point was positioned in a region outside the heating member.

The component detected in the supporting layer of the heating member, the depth of the concave portion in the supporting layer, the rate of fluororesin area to the entire of the surface layer, whether there was a non-attached region having an area of from 0.01 to 0.03 $\mu m^2$ on concave portions, the thickness of the supporting layer, and Vickers hardness of the heating member of the printing device of Examples 1 to 11 and Comparative Examples 1 to 4 were shown in Tables 1 and 2.

In the surface layer of the heating member of the printing devices of Examples 1 to 11, the fluororesin area in the concave portion per unit area was larger than the fluororesin area in the non-concave portion per unit area.

In the printing devices of Comparative Examples 1 to 11 and Comparative Examples 1 to 4, the temperature difference ΔT between the temperature measured by the temperature measuring member and the real temperature measured by a contact type thermocouple was obtained and evaluated in the following manner in the case where heat was supplied while substantially maintaining the temperature of the heating member that lowered upon contact between the heating subject and the heating member.

In the printing devices of Comparative Examples 1 to 11 and Comparative Examples 1 to 4, the degree of transfer, the transfer property, of the component derived from the liquid composition from the heating subject to the heating member was obtained and evaluated in the following manner.

Evaluation on Temperature Difference ΔT

Using the printing devices of Comparative Examples 1 to 11 and Comparative Examples 1 to 4, an adjusted liquid composition, ink, was applied to a heating subject as a printing medium to print an image thereon. The printing medium used was low permeative roll paper, Lumi Art Gloss 130 gsm, paper width of 125 mm, manufactured by Stora Enso. The length of the roll paper along the conveyance direction was longer than the conveyance path of the printing device. The roll paper was placed in the printing device. Solid images corresponding to the length of 12 km of the roll paper were printed at a printing speed of 50 m/min. The printing device supplied heat based on the temperature measured by the radiation thermometer as the temperature measuring member while substantially maintaining the temperature of the heating member at 140 degrees C. that lowered upon contact between the heating subject and the printing medium.

During printing the amount of 12 km, the largest temperature difference ΔT, the difference between the temperature Tn measured by the radiation thermometer as the temperature measuring member and the real temperature Tr measured by the contact type thermocouple, was obtained and evaluated according to the following evaluation criteria. The evaluation results are shown in Tables 1 and 2.

Evaluation Criteria

A: ΔT is less than 5 degrees C.

B: ΔT is from 5 to less than 10 degrees C.

C: ΔT is greater than 10 degrees C.

Evaluation on Transfer Property

After evaluating the ΔT, the area where the component derived from the ink remaining on the surface of the heating member was attached was obtained and evaluated according to the following evaluation criteria. The evaluation results are shown in Tables 1 and 2.

Evaluation Criteria

Δ+: Area less than 1 percent

Δ: Area of from 1 to less than 5 percent

B: Area of from 5 to less than 10 percent

C: Area of 10 percent or greater

TABLE 1

| | | Example | | | |
|---|---|---|---|---|---|
| | | 1 | 2 | 3 | 4 |
| Position of temperature measuring member | Length ratio ($L_{10}$:L) | 10 percent | 35 percent | 50 percent | 50 percent |
| | Position along conveyance direction | Upstream | Upstream | Upstream | Downstream |
| Type of aluminum | | A5052 | A5052 | A5052 | A5052 |
| Electrolysis | Electrolyte | Sulfuric acid | Sulfuric acid | Sulfuric acid | Sulfuric acid |
| | Electrolysis time (h) | 0.5 | 0.5 | 0.5 | 0.5 |
| Attaching resin | How to attach resin | Dipping | Dipping | Dipping | Dipping |
| | Number of attaching | 1 | 1 | 1 | 1 |
| Polishing | Number of polishing | 1 | 1 | 1 | 1 |
| Component detected in supporting layer | | Al, O, S | Al, O, S | Al, O, S | Al, O, S |
| Depth (μm) of concave portion in supporting layer | | 0.4 | 0.4 | 0.4 | 0.4 |
| Rate (percent) of fluororesin area in surface layer | | 10 | 10 | 10 | 10 |
| Whether there is non-attached region of from 0.01 to 0.03 $\mu m^2$ | | Yes | Yes | Yes | Yes |
| Depth (μm) of supporting layer | | 14 | 14 | 14 | 14 |
| Vickers hardness ($kgf/mm^2$) of heating member | | 351 | 351 | 351 | 351 |
| Temperature | Degrees C. | 9 | 6 | 6 | 4 |
| difference ΔT | Evaluation result | B | B | B | A |
| Transfer property | Percent | 6.6 | 6.6 | 6.6 | 6.6 |
| | Evaluation result | B | B | B | B |

TABLE 1-continued

| | | Example | | | |
|---|---|---|---|---|---|
| | | 5 | 6 | 7 | 8 |
| Position of temperature measuring member | Length ratio ($L_{10}$:L) | 50 percent | 50 percent | 50 percent | 50 percent |
| | Position along conveyance direction | Downstream | Downstream | Downstream | Downstream |
| Type of aluminum | | A5052 | A5052 | A6061 | A6061 |
| Electrolysis | Electrolyte | Sulfuric acid | Sulfuric acid | Sulfuric acid | Sulfuric acid |
| | Electrolysis time (h) | 1.0 | 1.0 | 1.0 | 1.0 |
| Attaching resin | How to attach resin | Dipping | Dipping | Dipping | Spraying |
| | Number of attaching | 1 | 1 | 1 | 1 |
| Polishing | Number of polishing | 2 | 1 | 1 | 1 |
| Component detected in supporting layer | | Al, O, S | Al, O, S | Al, O, S, Si | Al, O, S, Si |
| Depth (μm) of concave portion in supporting layer | | 1.1 | 1.4 | 1.2 | 1.4 |
| Rate (percent) of fluororesin area in surface layer | | 26 | 29 | 30 | 26 |
| Whether there is non-attached region of from 0.01 to 0.03 $\mu m^2$ | | Yes | Yes | Yes | None |
| Depth (μm) of supporting layer | | 22 | 29 | 31 | 28 |
| Vickers hardness ($kgf/mm^2$) of heating member | | 388 | 390 | 450 | 458 |
| Temperature difference ΔT | Degrees C. | 4 | 4 | 4 | 4 |
| | Evaluation result | A | A | A | A |
| Transfer property | Percent | 4.4 | 2.5 | 0.6 | 3.8 |
| | Evaluation result | A | A | A+ | A |

| | | Example | | |
|---|---|---|---|---|
| | | 9 | 10 | 11 |
| Position of temperature measuring member | Length ratio ($L_{10}$:L) | 50 percent | 50 percent | 50 percent |
| | Position along conveyance direction | Downstream | Downstream | Downstream |
| Type of aluminum | | A6061 | A6061 | A6061 |
| Electrolysis | Electrolyte | Sulfuric acid | Sulfuric acid | Sulfuric acid |
| | Electrolysis time (h) | 1.0 | 2.0 | 2.0 |
| Attaching resin | How to attach resin | Spraying | Spraying | Spraying |
| | Number of attaching | 2 | 2 | 2 |
| Polishing | Number of polishing | 1 | 1 | 2 |
| Component detected in supporting layer | | Al, O, S, Si | Al, O, S, Si | Al, O, S, Si |
| Depth (μm) of concave portion in supporting layer | | 1.6 | 1.9 | 2.2 |
| Rate (percent) of fluororesin area in surface layer | | 61 | 58 | 44 |
| Whether there is non-attached region of from 0.01 to 0.03 $\mu m^2$ | | None | None | None |
| Depth (μm) of supporting layer | | 31 | 48 | 46 |
| Vickers hardness ($kgf/mm^2$) of heating member | | 448 | 480 | 474 |
| Temperature difference ΔT | Degrees C. | 4 | 4 | 4 |
| | Evaluation result | A | A | A |
| Transfer property | Percent | 4.7 | 6.9 | 7.5 |
| | Evaluation result | A | B | B |

TABLE 2

| | | Comparative Example | | | |
|---|---|---|---|---|---|
| | | 1 | 2 | 3 | 4 |
| Position of temperature measuring member | Length ratio ($L_{10}$:L) | 50 percent | 50 percent | 50 percent | 110 percent |
| | Position along conveyance direction | Downstream | Downstream | Downstream | Upstream |
| Type of aluminum | | A5052 | A5052 | A5052 | A5052 |
| Electrolysis | Electrolyte | Oxalic acid | — | — | Sulfuric acid |
| | Electrolysis time (h) | 2.0 | — | — | 0.5 |
| Attaching resin | How to attach resin | Dipping | — | Cover | Dipping |
| | Number of attaching | 1 | — | — | 1 |
| Polishing | Number of polishing | 1 | — | — | 1 |
| Component detected in supporting layer | | Al, O | — | — | Al, O, S |
| Depth (μm) of concave portion in supporting layer | | 0.1 | — | — | 0.4 |
| Rate (percent) of fluororesin area in surface layer | | 15 | — | — | 10 |
| Whether there is non-attached region of from 0.01 to 0.03 $\mu m^2$ | | Yes | — | — | Yes |
| Depth (μm) of supporting layer | | 30 | — | — | 14 |
| Vickers hardness ($kgf/mm^2$) of heating member | | 401 | — | — | 351 |
| ΔT | Degrees C. | 4 | 80 | 82 | 16 |
| | Evaluation result | A | C | C | C |
| Ink attached area | Percent | 10.4 | 12.8 | 11.9 | 6.6 |
| | Evaluation result | C | C | C | B |

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A drying device comprising:

a heating member configured to convey and heat a heating subject in a contact manner on which a liquid composition has been applied, the heating member comprising:

a substrate;

a surface layer disposed on the substrate, the surface layer comprising:

a supporting layer comprising sulfuric acid anodized aluminum film having concave portions and non-concave portions; and a fluororesin at least partially attached to the concave portions; and a heating device configured to heat the heating subject via the surface layer; and a temperature measuring member configured to measure a temperature of a temperature measuring point in a region of the heating member that has contacted the heating subject in a non-contact manner.

2. The drying device according to claim 1, wherein a distance between one end of the region and the temperature measuring point along a perpendicular direction to a direction of conveying the heating subject is from 30 to 70 percent of a distance between the one end and another end of the region along the perpendicular direction.

3. The drying device according to claim 1, wherein the temperature measuring point is closer to a separation starting point where the heating subject starts separating from the heating member than a contact starting point where the heating subject starts contacting the heating member.

4. The drying device according to claim 1, wherein the concave portions have a depth of from 0.2 to 2.0 μm.

5. The drying device according to claim 1, wherein a ratio of an area where the fluororesin is present to an entire area of the surface layer is from 15 to 30 percent.

6. The drying device according to claim 1, wherein the concave portions comprise fluororesin attached regions and fluororesin non-attached regions, wherein at least one of the fluororesin non-attached regions has an area of from 0.01 to 0.03 $\mu m^2$.

7. The drying device according to claim 1, wherein the supporting layer has a thickness of from 25.0 to 35.0 μm.

8. The drying device according to claim 1, wherein the heating member is a roller having a diameter of from 50 to 600 mm.

9. The drying device according to claim 1, wherein an area where the fluororesin is present in a unit area of the concave portions is larger than an area where the fluororesin is present in a unit area of the non-concave portions.

10. The drying device according to claim 1, wherein the surface layer is configured to have a temperature of 50 degrees C. or higher.

11. A printing device comprising:

an applying device configured to apply a liquid composition to a heating subject; and a drying device comprising:

a heating member configured to convey and heat the heating subject in a contact manner on which the liquid composition has been applied, the heating member comprising:

a substrate;

a surface layer disposed on the substrate, the surface layer comprising:

a supporting layer having sulfuric acid anodized aluminum film having concave portions and non-concave portions; and a fluororesin attached to the concave portions; and a heating device configured to heat the heating subject via the surface layer; and a temperature measuring member configured to measure a temperature of a temperature measuring point in a region of the heating member that has contacted the heating subject.

* * * * *